US008602131B2

(12) United States Patent
Colin et al.

(10) Patent No.: US 8,602,131 B2
(45) Date of Patent: Dec. 10, 2013

(54) PROCESS FOR MANUFACTURING A PART COMPRISING A BLOCK OF DENSE MATERIAL CONSTITUTED OF HARD PARTICLES AND OF BINDER PHASE HAVING A GRADIENT OF PROPERTIES, AND RESULTING PART

(75) Inventors: Christophe Colin, Evry (FR); Elodie Sorlier, Paris (FR); Alfazazi Dourfaye, Paris (FR)

(73) Assignee: Varel International, Ind., L.P., Carrollton, TX (US)

( * ) Notice: Subject to any disclaimer, the term of this patent is extended or adjusted under 35 U.S.C. 154(b) by 358 days.

(21) Appl. No.: 13/121,366

(22) PCT Filed: Oct. 7, 2009

(86) PCT No.: PCT/FR2009/051910

§ 371 (c)(1),
(2), (4) Date: Mar. 28, 2011

(87) PCT Pub. No.: WO2010/040953

PCT Pub. Date: Apr. 15, 2010

(65) Prior Publication Data

US 2011/0174550 A1 Jul. 21, 2011

(30) Foreign Application Priority Data

Oct. 7, 2008 (FR) ..... 08 56771

(51) Int. Cl.

| | |
|---|---|
| ***E21B 10/46*** | (2006.01) |
| ***B22D 17/24*** | (2006.01) |
| ***B22D 19/00*** | (2006.01) |
| ***B22F 3/00*** | (2006.01) |
| ***B22F 5/00*** | (2006.01) |
| ***B22F 7/00*** | (2006.01) |
| ***C22C 29/02*** | (2006.01) |

(52) U.S. Cl.
USPC ..... 175/433; 164/332; 428/551; 75/236

(58) Field of Classification Search
USPC ..... 175/434, 432, 433; 164/332; 428/551; 75/236
See application file for complete search history.

(56) References Cited

U.S. PATENT DOCUMENTS

| | | | |
|---|---|---|---|
| 3,745,623 | A | 7/1973 | Wentorf, Jr. et al. |
| 4,225,322 | A | 9/1980 | Knemeyer |

(Continued)

FOREIGN PATENT DOCUMENTS

| | | | |
|---|---|---|---|
| DE | 3112460 | A1 | 9/1982 |
| DE | 203750 | A1 | 11/1983 |

(Continued)

OTHER PUBLICATIONS

C. Colin et al., "Effect of shape accomodation on the equilibrium distribution of liquid in assemblies of WC/Co cermets", Proceedings 4th International Conference of Science, Technology and Applications of Sintering, 2005 (pp. 188-191).

(Continued)

*Primary Examiner* — Jennifer H Gay
(74) *Attorney, Agent, or Firm* — Gardere Wynne Sewell LLP; Andre M. Szuwalski

(57) ABSTRACT

A block of dense material is made up of hard particles, of the same or different nature, dispersed in a binder phase. The material has a solidus temperature $T_s$ above which the binder phase is liquid. There is deposited on at least a portion of the surface of the block of dense material an active coating composed of a material capable of reacting chemically with the dense material when the assembly is heated to beyond a minimum reaction temperature $T_r$. The block coated with the active coating is subjected to a heat treatment comprising heating, then maintenance for a time $t_m$ at a maintenance temperature $T_m$ greater than or equal to the minimum reaction temperature $T_r$, followed by cooling to ambient temperature.

22 Claims, 3 Drawing Sheets

(56) References Cited

U.S. PATENT DOCUMENTS

| | | | | |
|---|---|---|---|---|
| 4,402,764 | A | 9/1983 | Clark et al. | |
| 4,548,786 | A | 10/1985 | Yohe | |
| 4,604,106 | A | 8/1986 | Hall | |
| 4,610,931 | A | 9/1986 | Nemeth et al. | |
| 4,726,718 | A | 2/1988 | Meskin et al. | |
| 4,729,440 | A | 3/1988 | Hall | |
| 4,743,515 | A | 5/1988 | Fischer et al. | |
| 4,820,482 | A | 4/1989 | Fischer et al. | |
| 4,943,488 | A | 7/1990 | Sung et al. | |
| 5,011,514 | A | 4/1991 | Cho et al. | |
| 5,028,177 | A | 7/1991 | Meskin et al. | |
| 5,079,102 | A | 1/1992 | Tanaka et al. | |
| 5,111,895 | A | 5/1992 | Griffin | |
| 5,441,817 | A | 8/1995 | Rai | |
| 5,618,625 | A | 4/1997 | Okamura et al. | |
| 5,713,133 | A | 2/1998 | Bhat et al. | |
| 5,880,382 | A | 3/1999 | Fang et al. | |
| 5,889,219 | A | 3/1999 | Moriguchi et al. | |
| 6,054,693 | A | 4/2000 | Barmatz et al. | |
| 6,562,462 | B2 | 5/2003 | Griffin et al. | |
| 6,620,375 | B1 | 9/2003 | Tank et al. | |
| 6,869,460 | B1 | 3/2005 | Bennett et al. | |
| 7,377,341 | B2 | 5/2008 | Middlemiss et al. | |
| 7,396,501 | B2 | 7/2008 | Pope et al. | |
| 7,487,849 | B2 * | 2/2009 | Radtke | 175/434 |
| 7,533,740 | B2 | 5/2009 | Zhang et al. | |
| 7,569,179 | B2 | 8/2009 | Fang | |
| 7,887,747 | B2 | 2/2011 | Iwasaki et al. | |
| 2002/0051848 | A1 | 5/2002 | Li | |
| 2002/0077054 | A1 | 6/2002 | Sung | |
| 2002/0096306 | A1 | 7/2002 | Butcher et al. | |
| 2004/0094333 | A1 | 5/2004 | Yamamoto et al. | |
| 2005/0230155 | A1 | 10/2005 | Sung | |
| 2005/0276717 | A1 | 12/2005 | Fang | |
| 2006/0254830 | A1 * | 11/2006 | Radtke | 175/426 |
| 2007/0131459 | A1 | 6/2007 | Voronin et al. | |
| 2007/0214913 | A1 | 9/2007 | Fang | |
| 2008/0185189 | A1 | 8/2008 | Griffo et al. | |
| 2008/0230280 | A1 | 9/2008 | Keshavan et al. | |
| 2008/0240879 | A1 * | 10/2008 | Dourfaye et al. | 408/144 |
| 2009/0173547 | A1 | 7/2009 | Voronin et al. | |
| 2009/0226688 | A1 | 9/2009 | Fang | |
| 2010/0151266 | A1 | 6/2010 | Arvanitidis | |
| 2011/0042147 | A1 | 2/2011 | Fang et al. | |
| 2011/0174550 | A1 * | 7/2011 | Colin et al. | 175/434 |

FOREIGN PATENT DOCUMENTS

| | | | |
|---|---|---|---|
| EP | 1975264 | A1 | 10/2008 |
| GB | 2438073 | | 11/2007 |
| JP | 62074076 | A | 4/1987 |
| WO | WO-9308952 | A1 | 5/1993 |
| WO | WO-2009111749 | A1 | 9/2009 |

OTHER PUBLICATIONS

E. Sorlier et al., "Elaboration de gradients de composition continue dans des taillants PDC", Materiaux 2006, Nov. 13-17, 2006, Dijon, France, May 10, 2007, http://hal.archives-ouvertes.fr/docs/00/14/45/46/PDF/Sorlier-Colin_Materiaux_2006_Dijon_9_pdf, XP002532888 (9 Pages).

E. Sorlier et al., "HAL: hal-00144546, version 1—Elaboration de gradients de composition continue dans des taillants PDC", http:://hal.archives-ouvertes.fr/hal-00144546/en/, Abstract, May 10, 2007 (1 Page).

Jain et al., "Processing of Functionally Graded WC/Co/Diamond Nanocomposites," Scripta Materialia, Elsevier, Amsterdam, NL, vol. 44, No. 8-9, May 18, 2001, XP004327717; ISSN: 1359-6462 (pp. 2099-2103).

O. Eso et al., "Liquid phase sintering of functionally graded WC-Co composites", International Journal of Refractory Metals & Hard Materials, 23, 2005 (pp. 233-241).

Park Jong-Ku et al., "Anomalous Growth of the Complex Carbide Phase in Carbon-deficient WC-Co Hard Metal during the Infiltration of Eutectic Liquid," Materials Science and Engineering, vol. A105-6, No. part 1, Nov. 9, 1987, XP-002458195 (pp. 233-236).

PCT International Search Report and Written Opinion for FR 0856771 dated Jul. 20, 2009 (11 pages).

PCT International Search Report and Written Opinion for PCT/FR2009/051910, dated Jan. 29, 2010 (10 pages).

PCT International Search Report and Written Opinion for PCT/US2009/060547, dated Dec. 14, 2009 (10 pages).

Roebuck et al., "Infiltration as a Method for Producing WC Hardmetals with Co and Ni Alloy Binder-Phases", International Journal of Refractory and Hard Metals, MPR Publishing Services Ltd., Shrewbury, GB, vol. 3, No. 1, Mar. 1, 1984, XP 000569229; ISSN: 0263-4368 (pp. 35-40).

P. Cao, et al.: "Optimization Design and Residual Thermal Stress Analysis of PDC Functionally Graded Materials," J. Zhejiang Univ. Science A, 2006 7(8), pp. 1318-1323.

* cited by examiner

PROCESS FOR MANUFACTURING A PART COMPRISING A BLOCK OF DENSE MATERIAL CONSTITUTED OF HARD PARTICLES AND OF BINDER PHASE HAVING A GRADIENT OF PROPERTIES, AND RESULTING PART

PRIORITY CLAIM

The present application is a 371 filing from PCT/FR2009/051910, filed Oct. 7, 2009, which claims priority from French Application for Patent No. 0856771, filed Oct. 7, 2008, the disclosures of which are hereby incorporated by reference.

TECHNICAL FIELD

The present invention relates to a process for manufacturing a component comprising a block of dense material made up of hard particles dispersed in a binder phase by thermochemical treatment, the component having a property gradient.

BACKGROUND

Numerous components, in particular the cutting edges of drilling tools or machine tools, are formed by blocks of material of the cemented carbide type which are made up of carbide particles dispersed in a metal binder phase. These materials, which are extremely hard, and therefore resistant to wear, may also be brittle. Therefore, in order to reinforce their toughness, they are subjected to treatments which are intended to introduce into them a ductile-phase composition gradient with or without the formation of new phases, the hardness of which differs from the initial hardness of the block, which result either in blocks of which the external surface, or at least a portion of that surface, is extremely hard and the internal portion is tougher, or in blocks of which the external surface, or at least a portion thereof, is tougher and the internal portion is harder.

To do this, it is possible to manufacture blocks of non-dense cemented carbide having a porosity gradient, which blocks are produced by powder metallurgy and which are caused to be infiltrated by a binder phase in order to improve their core ductility. This method is poorly suited, in particular, to the system of the WC-Co type because it leads to the partial destruction of the carbide skeleton existing before infiltration, and therefore does not enable the desired properties for a cutting edge to be obtained.

It has also been proposed to produce cemented carbides having a composition gradient by the solid-phase natural sintering of a multi-layered component, each of the layers having a different composition. However, this method does not enable the material to be completely densified and has to be followed by an expensive hot isostatic compaction treatment. Furthermore, the preparation of the cemented carbide having a composition gradient is complex since it requires the production of a succession of basic layers which fit into one another. Finally, this process has the disadvantage of not generating a continuous composition gradient.

It has also been proposed to produce such materials by liquid-phase natural sintering, which enables a material having a completely dense composition gradient to be obtained very rapidly and in a single step. However, this process has the disadvantage of attenuating the composition gradient to a fairly great extent owing to the migration of liquid between the layers of small thickness under the combined effect of infiltration and impregnation phenomena. In addition, and against all expectation, the composition gradient remains discontinuous when the duration of maintenance in the liquid state is less than a critical duration beyond which complete homogenization of the cemented carbide is observed, but is sufficient to densify the material.

Furthermore, it has been proposed to improve the operating performance of cutting tools by depositing hard coatings of nitride, carbonitride, oxide or boride on the surface of the cemented carbide. Such methods have been described, for example, in U.S. Pat. Nos. 4,548,786 and 4,610,231 (the disclosures of which are hereby incorporated by reference). However, these methods have the disadvantage of improving only the resistance of the cemented carbide to wear by abrasion, and of doing this only over small thicknesses (a few microns).

It has also been proposed to improve both the resistance to wear of the surface and the shock resistance of cemented carbides of the WC-Co type by bringing a carbon-rich gaseous phase into contact with a dense cemented carbide sub-stoichiometric in carbon. Under the effect of temperature, the carbon of the gaseous phase diffuses in the sub-stoichiometric cemented carbide and reacts with the phase $\eta$-$Co_3W_3C$, which leads to a release of cobalt which migrates towards the external surface of the cemented carbide, that is to say, behind the carbon diffusion front. This method described in the U.S. Pat. No. 4,743,515 (the disclosure of which is hereby incorporated by reference) has the disadvantage of leading to a cobalt-rich binder phase gradient over 1 or 2 mm while preserving a brittleness of the core of the component treated.

In order to overcome the various shortcomings of the methods which have just been set forth, it has been proposed to manufacture blocks of cemented carbide having a binder phase composition gradient over distances of the order of millimeters by enriching the cemented carbides by impregnation from the outside from a liquid phase capable of penetrating (or migrating) into the cemented carbide. This impregnation phenomenon corresponds to the migration of external liquid having a composition similar to that of the solid/liquid system regarded as completely dense under the sole moving force of the migration pressure generated by a local imbalance of the volume fraction of binder phase and/or the size and morphology of the solid grains. This phenomenon concerns any system made up of (solid and liquid) condensed phases which exhibits an aptitude to adapt the shape of its solid grains by absorbing liquid, thus rendering it energetically more stable, that is to say, which exhibits an Ostwald ripening with modification of the shape of the hard particles without necessarily generating an enlargement of those particles by the phenomenon of dissolution and re-precipitation.

The use of this process to manufacture cutting edges for drilling tools or cutting tools requires the production of preliminary assemblies of a dense sintered block which is to be enriched and a compacted powder pellet of impregnation material which is to introduce the binder phase by the impregnation phenomenon, and the placing of the assembly in an oven in order to effect the appropriate heat treatment. This process has the disadvantage of requiring an impregnation material which should be dimensioned relative to the desired composition gradient, which complicates the process and generally necessitates an adjustment of the impregnation surface.

SUMMARY

Very unexpectedly, the inventors have found that it is possible to generate binder phase concentration gradients over distances of the order of millimeters inside blocks of dense cemented carbide with the sole proviso that a suitable coating is deposited on all or part of the surface of the dense block of cemented carbide and that it is subjected to a suitable heat treatment, the temperature of which must be at least equal to the temperature that enables the binder phase to pass into the liquid state (solidus of the cemented carbide concerned).

The material constituting the coating becomes unstable (or decomposes) and one or more of the chemical elements of which it is composed diffuse(s) and react(s), or not, with the material of the block, thus generating a binder phase gradient in the block and/or the formation of phases the hardness of which differs from the initial hardness of the block over more or less great distances, depending on the duration of the heat treatment applied. The shape of the gradient so generated in the block: hardening of the surface beneath which the coating has been deposited and softening of the core or, conversely, softening of the surface beneath which the coating has been applied and hardening of the core, depends in particular on the nature and thickness of the coating used, the proportion of the surface coated and the heat treatment. The parameters of the heat treatment can be determined by the person skilled in the art, in particular in accordance with the shape of the desired gradient.

Therefore, the invention relates to a process for manufacturing a component comprising a block of dense material made up of hard particles, of the same or different nature, dispersed in a binder phase, the material having a solidus temperature $T_s$ above which the binder phase is liquid, characterized in that there is deposited on at least a portion of the surface of the block of dense material an active coating composed of a material capable of reacting chemically with the dense material when the assembly is heated to beyond a minimum reaction temperature $T_r$, and in that the block coated with the active coating is subjected to a heat treatment comprising heating, then maintenance for a time $t_m$ at a maintenance temperature $T_m$ greater than or equal to the minimum reaction temperature $T_r$, followed by cooling to ambient temperature.

Preferably, the maintenance temperature $T_m$ is greater than or equal to the solidus temperature $T_s$ of the dense material.

Preferably, the maintenance temperature $T_m$ is less than or equal to $T_s$+200° C.

Preferably, the maintenance time $t_m$ is from 1 minute to 10 minutes.

The active coating may be deposited on only a portion of the surface of the block.

The active coating may be deposited on the entire surface of the block.

The dense material is, for example, a cemented carbide composed of metal carbide particles dispersed in a metal matrix.

The cemented carbide may also contain particles of natural or synthetic diamond measuring up to 1 mm in diameter.

The cemented carbide is, for example, of the WC-M type, M being one or more metals selected from Co, Ni and Fe, the sum of the contents by weight of these metals in the binder phase being greater than 50%.

The coating material capable of reacting with the dense material of the block is composed, for example, of at least one compound selected from compounds of the nitride, boride, carbide, oxide, hydride, carbonitride, borocarbide and graphite type. This material may be composed of any mixture of these various compounds.

The coating can be deposited by a process of the PVD (Physical Vapor Deposition) or CVD (Chemical Vapor Deposition) type, or by a spraying process or using a brush or by dipping or by serigraphy.

The block of dense material is, for example, a cutting edge or a support block of a cutting edge of a tool for drilling or hewing or machining rocks or metals.

In addition, it is possible to deposit on a face of the support block a diamond wafer of the PDC (Polycrystalline Diamond Compact) or TSP (Thermally Stable Polycrystalline diamond) type.

The diamond wafer can be attached to the block by brazing, after the block has been treated.

This thermal process therefore has the advantage of producing in a very simple manner blocks of cemented carbide having a property gradient suitable for use as the cutting edge of a drilling tool or a cutting tool, or as a support block of the cutting edge of a drilling tool or a cutting tool.

The invention relates also to a cutting edge for a tool for cutting rocks, which comprises a block made up of hard particles dispersed in a binder phase, which block can be obtained by the process according to the invention and which has, over a distance greater than 0.5 mm, preferably greater than 1 mm, and more preferably greater than 3 mm, a continuous gradient of binder phase content, the difference in binder phase content between the richest zone and the poorest zone being greater than 1% by volume, preferably greater than 2%, and more preferably greater than 5%.

The cutting edge may comprise an attached diamond wafer of the PDC or TSP type of a thickness which may be from 0.4 mm to 5 mm.

The invention relates also to a tool for cutting rocks which comprises at least one cutting edge or blade of impregnated material composed of a mixture of cemented carbide and particles of natural or synthetic diamond (which may measure up to 1 mm in diameter).

BRIEF DESCRIPTION OF THE DRAWINGS

The invention will now be described in a more detailed but non-limiting manner with reference to the appended Figures, in which.

DETAILED DESCRIPTION OF THE DRAWINGS

Figure 1:
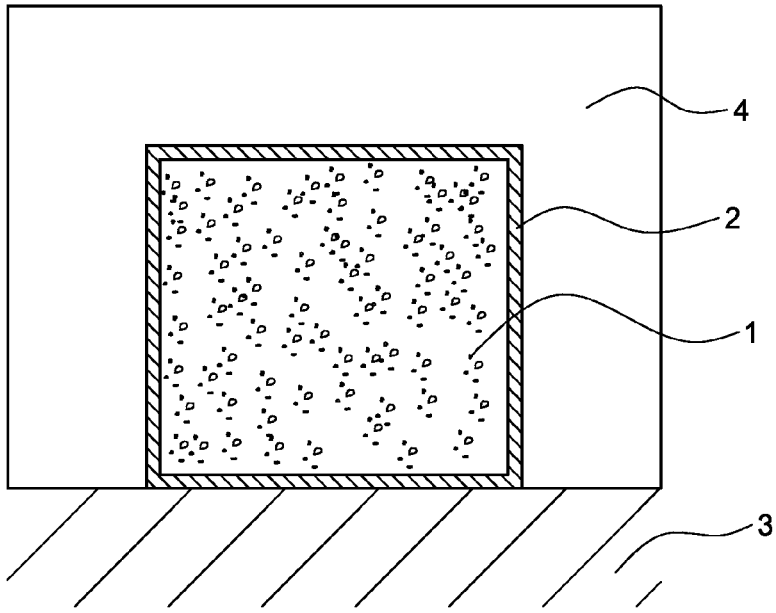
FIG. 1 is a sectioned view of a block of dense cemented carbide completely covered with a coating, the whole being located in a heat treatment oven.

In the following, blocks intended in particular for the manufacture of cutting edges for drilling tools or more generally for cutting tools, of a generally parallelepipedal shape or of a cylindrical shape, having dimensions of the order of a few millimeters or a few tens of millimeters, will be considered. These blocks, obtained by powder metallurgy, are composed of a dense material, the structure of which comprises, on the one hand, hard particles, such as metal carbides, and in particular tungsten carbides, and, on the other hand, a binder phase composed principally of a metal or a metal alloy. When in contact with the carbides, this binder phase can form, at a suitable temperature, a eutectic, the melting point of which is lower than both the melting point of the carbides and the melting point of the metal or metal alloy. This metal or metal alloy constituting the binder phase is, for example, cobalt, but may also be iron or nickel or a mixture of these metals, these elements representing at least 50% by weight of the binder phase.

The binder phase may also contain addition elements, the sum of the contents of which may be at most 15% by weight but in general does not exceed 5%. These addition elements may be copper in order to improve the electrical conductivity, or silicon which has a surfactant effect with respect to the system made up of the carbides and the binder phase. The addition elements may also be carbide-producing elements permitting the formation of mixed carbides or carbides of the $M_xC_y$ type other than tungsten carbide. These elements are, in particular, manganese, chromium, molybdenum, tungsten, vanadium, niobium, tantalum, titanium, zirconium and hafnium.

In addition, the binder phase may comprise addition elements which modify the shape and/or inhibit the enlargement of the hard particles and with which the person skilled in the art is familiar.

Finally, the chemical composition of these materials comprises inevitable impurities which result from the production processes.

For some applications, in order to reinforce the resistance to wear of the cutting edges, it is possible to add particles of natural or synthetic diamond, the diameter of which may be as much as 1 mm. These diamond particles are added to the powder mixture which is used to manufacture the block by sintering and which is known as impregnated material.

According to the invention, in order to produce a block of cemented carbide having a property gradient, the block 1 of dense material is coated with a layer 2 of a thickness of generally approximately from 50 μm to 2 mm, of a material capable of reacting chemically with the binder phase and/or the carbide phase of the dense material. This coating is produced by spraying, PVD deposition (Physical Vapor Deposition) or CVD deposition (Chemical Vapor Deposition) if the coating material is supplied in gaseous form, or using a brush, or by dipping or by serigraphy if the coating material is supplied in liquid form. The assembly is then placed at the bottom 3 of an oven 4 and the assembly is heated to a maintenance temperature $T_m$ and the assembly is maintained at that temperature for a time $t_m$ in order to ensure the interaction of the external coating or one of its constituent elements with the dense material and to bring about the formation of a property gradient inside the block. In order to do this, the maintenance temperature $T_m$ must be greater than or equal to the minimum reaction temperature $T_r$ which is the temperature above which the external coating or one of its elements starts to react or diffuse without reacting in a significant manner inside the block. This reaction temperature $T_r$ must be greater than or equal to the solidus temperature $T_s$ of the cemented carbide constituting the block. This solidus temperature is the minimum temperature at which the binder phase of the cemented carbide is in the liquid state. This condition is desirable so that the coating or one of its constituent elements can rapidly diffuse and then react or not, depending on the coating concerned, with the constituents (solid grains or liquid phase) of the block being treated. If the coating is composed of a compound with a metalloid, such as boron or any other metalloid, or a non-metal, such as carbon, nitrogen, oxygen, or any other non-metal, the reaction temperature $T_r$ is greater than or equal to the destabilization or decomposition temperature $T_d$ of the compound which is not necessarily greater than the solidus temperature $T_s$ of the cemented carbide. The reaction temperature $T_r$, the destabilization temperature $T_d$ and the solidus temperature $T_s$ depend on the nature of the material of which the coating is made and the material of which the block is made. The person skilled in the art knows how to determine these temperatures.

The maintenance temperature $T_m$ must not be too high. Preferably, it must remain below $T_s$+200° C. and preferably below $T_s$+100° C. and more preferably below $T_s$+50° C. The maintenance time $t_m$ must for its part be suitable for the shape and the amplitude of the desired gradient and is deduced from experiment. It is generally of the order of a few minutes.

The coating material capable of becoming unstable or of decomposing and/or reacting with the material constituting the dense block to be treated is, for example, a metalloid or metal nitride, such as boron nitride, aluminum nitride, titanium nitride, or a boride, such as titanium boride, a metalloid or metal carbide, such as boron carbide, titanium carbide, or a hydride, such as titanium hydride, or graphite or a refractory oxide, such as alumina, or a carbonitride or a borocarbide of metal, or a mixture of such materials.

As indicated above, the materials used to produce the coating of the block to be treated must be active or even in some cases reactive above the solidus temperature $T_s$, but it is preferable for them to remain stable, that is to say, not to decompose, below that temperature.

It will be appreciated that, depending on the nature of the coating material and that of the material constituting the block, the property gradient obtained may result from a relative hardening of the surface of the block compared with the core, or conversely a softening.

Figure 4:
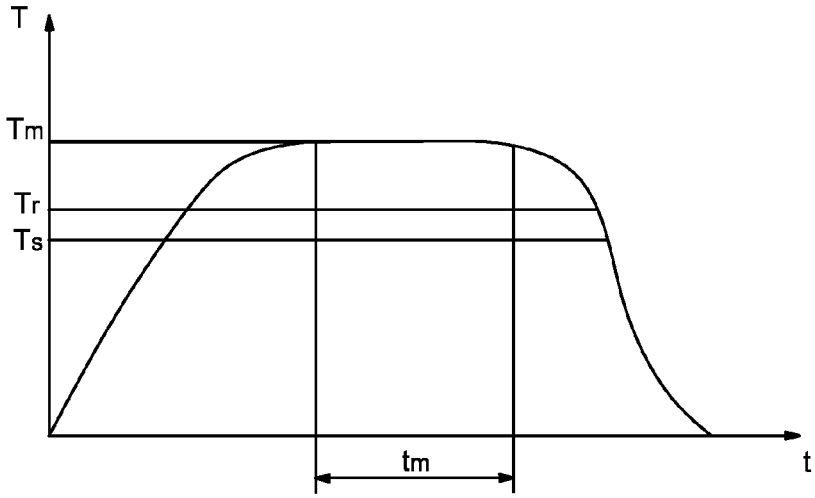
FIG. 4 is a scheme showing the development of the temperature as a function of time for a heat cycle of the treatment in respect of a coated dense cemented carbide block.

The heat treatment comprises, as shown in FIG. 4, an increase in temperature to the maintenance temperature $T_m$, then maintenance for a maintenance time $t_m$ at that temperature and a cooling to ambient temperature.

The maintenance time $t_m$ and the maintenance temperature $T_m$ are adapted in accordance with the dimensions of the block to be treated and the property gradient which it is desired to obtain.

The heat treatment can be carried out in a resistance oven, or an induction oven or a microwave oven, under a protective atmosphere or under vacuum. The protective atmosphere is, for example, argon or a mixture of argon and hydrogen but as a general rule any neutral atmosphere such as argon, nitrogen, hydrogenated argon, hydrogenated nitrogen, hydrogen, or optionally a rough or high vacuum.

Figure 2:
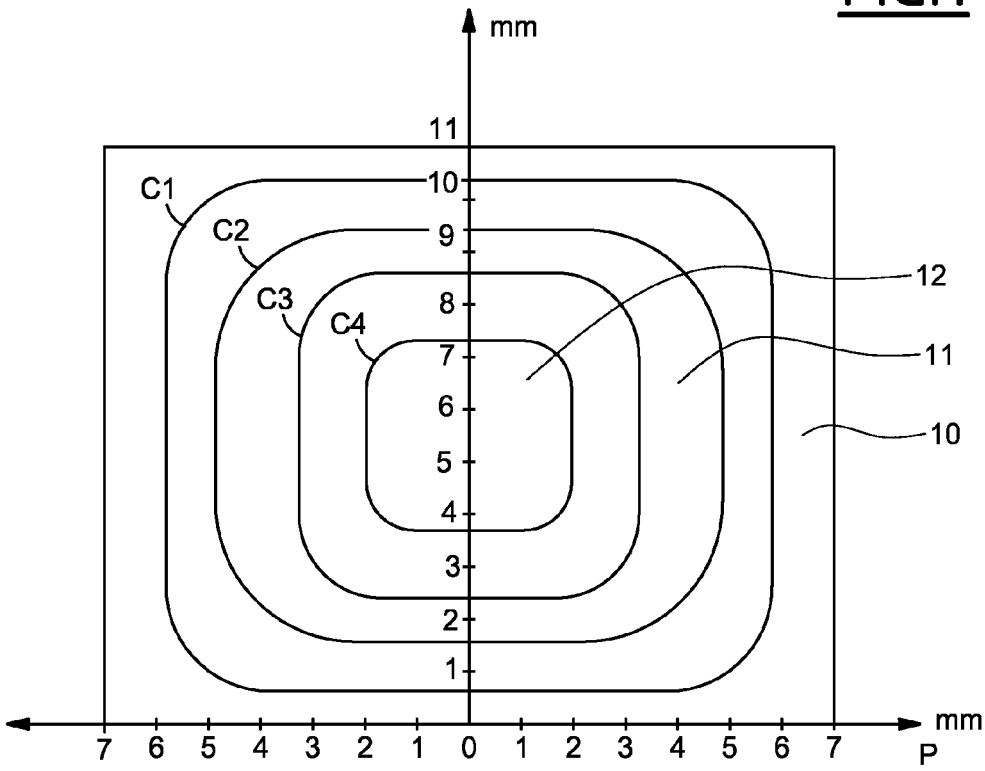
FIG. 2 is a sectioned view of a block of treated dense cemented carbide which shows the distribution of the binder phase concentration inside the block from the exterior surface towards the interior of the cemented carbide and the formation or non-formation of solid phases having a hardness different from the initial hardness of the block.

As shown in FIG. 2, the block so treated has a composition, in particular a binder phase content, which varies from the outside to the inside. The Figure shows binder phase iso-concentration curves Ci, the outermost zone 10 being the poorest in binder phase and consequently the hardest, and the intermediate zone 11 having an intermediate concentration, and the zone 12, which is the richest in binder phase, being the least hard and consequently the toughest. As represented in this FIG. 2, it can be seen that the variation in binder phase content occurs over several millimeters. Therefore, it appears that the action of one or more constituent elements of the deposited external layer with one of the constituents of the cemented carbide may cause phenomena of transfer (or migration) of the liquid binder phase from the outer zone towards the inner zone, depleting the outer zone to enrich the inner zone.

The extent of the zone affected by the variation in the binder phase content of course depends on the maximum maintenance temperature $T_m$, the maintenance time $t_m$ and the thickness of the coating material. With an equal thickness of the coating layer, the higher the temperature $T_m$ and the longer the time $t_m$, the more extensive is the zone affected; that is to say, the more the block is affected in depth.

The person skilled in the art knows how to adapt the treatment conditions to the results he wishes to obtain. It will also be appreciated that the block as just described is covered on all of its faces with an active material. However, the active material may be deposited on only a portion of the external surface of the block and therefore may lead to the hardening or softening of only the zones of the block located beneath the coating and may therefore have a softened or hardened zone at the core which may extend as far as the external surface of the block that is not coated.

It will be appreciated that this variation in the distribution of the binder phase inside the block over distances of the order of millimeters occurs without the supply of external binder phase. However, this does not mean that the total binder phase content of the block which has been treated remains identical, because binder phase has been able to combine with one or more elements of the coating to form a solid phase, thus depleting the binder phase content of the block.

The variation in hardness, which may be as much as several hundred Vickers, may occur over distances greater than 0.5 mm and may extend throughout the entire block.

By way of example, three treatments were carried out on blocks made of the same material, WC-Co containing approximately 13% by weight of cobalt ($HV_{2kg/10s}$=1220), in accordance with the same heat cycle ($T_m$=1350° C., $t_m$=5 min) with two different coatings (boron nitride, alumina) under vacuum and under hydrogenated argon.

Figure 5:
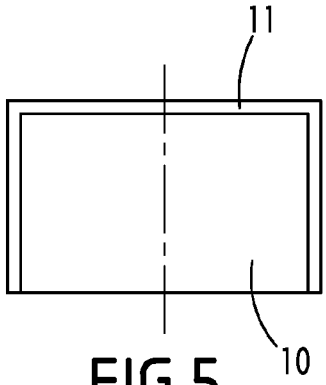
FIG. 5 shows schematically in section a first example of a cemented carbide block coated with boron nitride on its upper face and on its lateral faces.

The first block, marked 10 in FIG. 5, has been coated by spraying a layer 11 of boron nitride BN, covering the upper face and the lateral faces of the block, then treated under vacuum.

Figure 6:
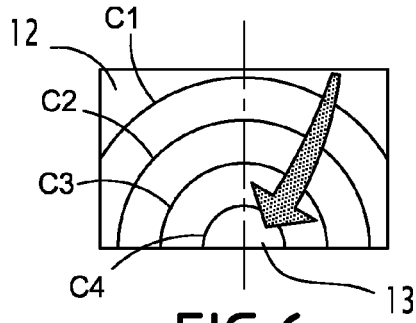
FIG. 6 shows schematically the dome-shape of the binder phase concentration gradient obtained from the block of FIG. 5, the external surface of which is poorer in binder phase than the core after treatment.

As shown schematically in FIG. 6, the binder phase concentration gradient obtained has the shape of a dome such that the zone 12 located beneath the coated surfaces has a hardness greater by approximately 130 HV than that of the zone 13 located at the core of the block. The direction of migration of the binder phase is indicated by the arrow and by the increasing direction of the iso-concentrations (C1<C2<C3<C4).

Figure 7:
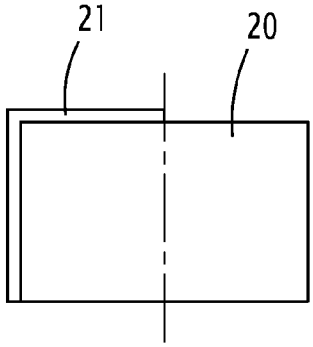
FIG. 7 and FIG. 8 show a second example of a block and a binder phase concentration gradient obtained, the block being coated with boron nitride on only a portion of its upper face and of its lateral faces.

The second block, marked 20 in FIG. 7, has also been coated with a layer 21 of boron nitride BN, but this layer has been deposited on only half of the block. In addition, the block has been treated under a hydrogenated argon atmosphere.

Figure 8:
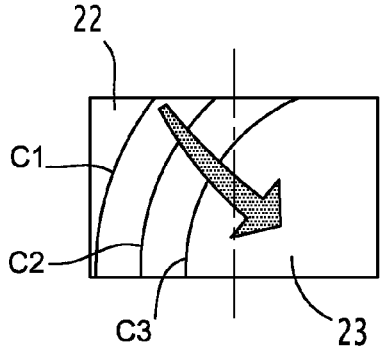

As shown in FIG. 8, the binder phase concentration gradient obtained leads to a hardness amplitude of 120 HV, only the zone 22 located beneath the coating being hardened, while the remainder 23 is not. Again, the direction of migration of the binder phase is indicated by the arrow and by the increasing direction of the iso-concentrations (C1<C2<C3).

Figure 9:
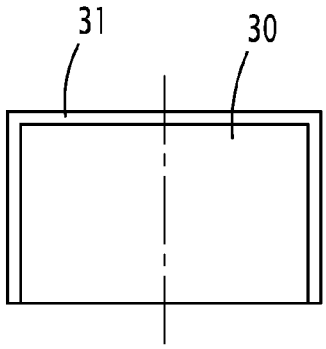
FIG. 9 and FIG. 10 show a third example of a block and a binder phase concentration gradient obtained, the block being coated with alumina on its upper face and on its lateral faces and its external surface being richer in binder phase than the core after treatment.
Figure 10:
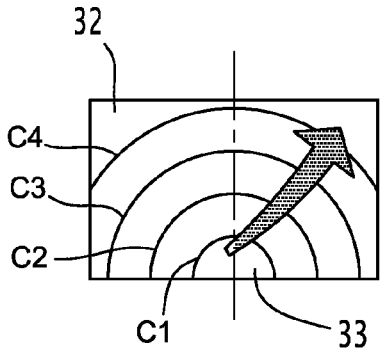

The third block, marked 30 in FIG. 9, has been coated with a layer 31 of aluminum oxide $Al_2O_3$ deposited in the form of a liquid paste using a brush on the upper face and on the lateral faces of the block and treated under vacuum. As shown in FIG. 10, the binder phase concentration gradient obtained is in the shape of a dome, but unlike what was obtained with the first block, the zone 32 close to the surface has been softened so that the hardness thereof is lower by 150 HV than that of the core zone 33. The direction of migration of the binder phase is indicated by the arrow and by the increasing direction of the iso-concentrations (C1<C2<C3<C4), the direction of which is the reverse of the two previous cases.

Thus, in the case of the material WC-Co considered, the boron nitride enables the zone of the block close to the coating layer to be hardened, while the alumina enables it to be softened.

On the other hand, the atmosphere of the oven (vacuum or hydrogenated argon) used to carry out the treatments has no effect on the result.

As indicated above, the blocks so treated may constitute cutting edges of a drilling tool or of a cutting tool and may have dimensions of a few millimeters or even more since it is possible to consider producing cutting blades which have dimensions of several centimeters and which may be hardened by this process.

Figure 3:
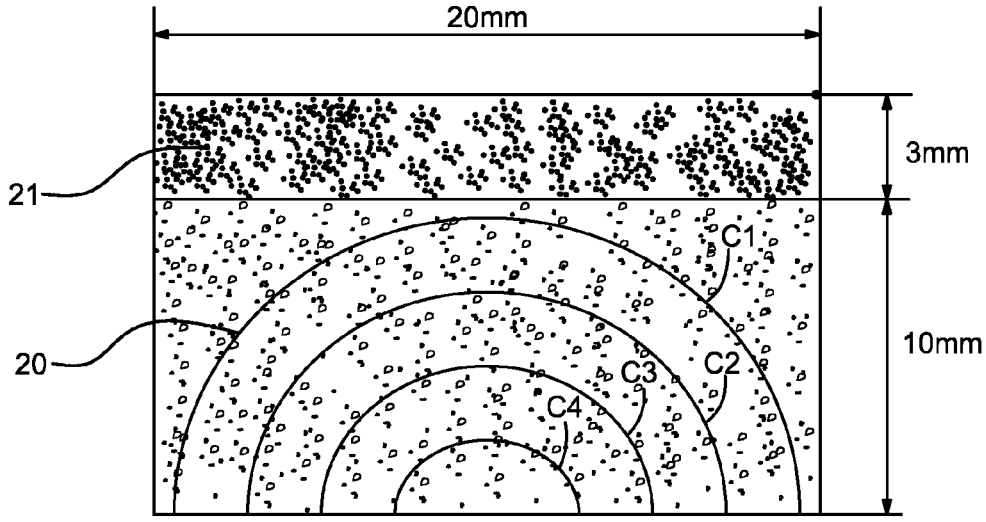
FIG. 3 is a sectioned schematic view of a cutting edge for drilling tools which is formed by a diamond wafer of a thickness of the order of millimeters deposited on a support block of dense cemented carbide treated in accordance with the invention, the lower surface of which has not been coated.

As shown in FIG. 3, it is also possible to produce a cutting edge for a tool for cutting rocks or for a tool for cutting refractory metals or for a machine tool, the cutting edge being constituted by a support block 20 of cemented carbide produced using the process according to the invention, the lateral surface of which is hard and the core of which is tougher (C1<C2<C3<C4) and the lower face of which has not been coated before the heat treatment, and to the upper face of which has been attached, after treatment, a wafer 21 of natural or synthetic diamond having a thickness greater than 0.4 mm in accordance with the HPHT (High Pressure–High Temperature) process, of the PDC (Polycrystalline Diamond Compact) type or of the TSP (Thermally Stable Polycrystalline diamond) type.

In particular, the support block 20 treated in accordance with the invention can be assembled after the HPHT process by brazing, for example in accordance with the process referred to as "LS Bond" and described in U.S. Pat. Nos. 4,225,322 and 5,111,895 (the disclosures of which are incorporated by reference) without this operation bringing about a drastic modification of the binder phase concentration gradient in the block.

Other cutting edges which the person skilled in the art can envisage may be produced by this process. These cutting edges can be incorporated in various tools known to the person skilled in the art, such as tools for breaking up rocks, for drilling heads, or machine tools.

The invention claimed is:

1. Process for manufacturing a component comprising a block of dense material made up of hard particles, of the same or different nature, dispersed in a binder phase, the material having a solidus temperature $T_s$ above which the binder phase is liquid, the process comprising:

depositing on at least a portion of the surface of the block of dense material an active coating composed of a material capable of reacting chemically with the dense material when the assembly is heated to beyond a minimum reaction temperature $T_r$, and subjecting the block coated with the active coating to a heat treatment comprising heating, then maintaining for a time $t_m$ at a maintenance temperature $T_m$ greater than or equal to said minimum reaction temperature $T_r$, followed by cooling to ambient temperature, the binder phase varying inside the block at millimeter-length distances without contribution of external binder phase and thus without leading to the total enrichment of the block in additional binder phase.

2. Process according to claim 1, wherein the maintenance temperature $T_m$ is greater than or equal to the solidus temperature $T_s$ of the dense material.

3. Process according to claim 1, wherein the maintenance temperature $T_m$ is between the solidus temperature $T_s$ of the dense material and a higher temperature which is equal to $T_s$+200° C.

4. Process according to claim 1, wherein the maintenance time $t_m$ is from 1 minute to 10 minutes.

5. Process according to claim 1, wherein the active coating is deposited on only a portion of the surface of the block.

6. Process according to claim 1, wherein the active coating is deposited on the entire surface of the block.

7. Process according to claim 1, wherein the dense material is a cemented carbide composed of metal carbide particles dispersed in a metal matrix.

8. Process according to claim 7, wherein the cemented carbide also contains particles of natural or synthetic diamond measuring up to 1 mm in diameter.

9. Process according to claim 7, wherein the cemented carbide is of the WC-M type, M being one or more metals selected from Co, Ni and Fe, the sum of the contents by weight of these metals in the binder phase being greater than 50%.

10. Process according to claim 1, wherein the coating material capable of reacting with the dense material of the block is composed of at least one compound selected from compounds of the nitride, boride, carbide, oxide, hydride, carbonitride, borocarbide or graphite type or of any mixture of these various compounds.

11. Process according to claim 1, wherein the coating is deposited by a process of the PVD (Physical Vapor Deposition) or CVD (Chemical Vapor Deposition) type, or by a spraying process or using a brush or by dipping or by serigraphy.

12. Process according to claim 1, wherein the block of dense material is a cutting edge or a support block of a cutting edge of a tool for drilling or hewing or machining.

13. Process according to claim 12, wherein, in addition, a diamond wafer of the PDC (Polycrystalline Diamond Compact) or TSP (Thermally Stable Polycrystalline diamond) type is deposited on a face of the support block.

14. Process according to claim 13, wherein the diamond wafer is attached to a face of the block by brazing, after the block has been treated.

15. Apparatus comprising a cutting edge for breaking up rocks, comprising a block made up of hard particles dispersed in a binder phase, which block is obtained by the process according to claim 1, wherein the block has, over a distance greater than 0.5 mm, a continuous gradient of binder phase content, the difference in binder phase content between the richest zone and the poorest zone being greater than 1% by volume.

16. Apparatus according to claim 15, further comprising an attached diamond wafer of the PDC or TSP type of a thickness greater than 0.4 mm.

17. A process, comprising:

depositing a coating on a surface of a block of dense cermet material comprising hard particles dispersed in a binder phase, said coating composed of a material capable of reacting chemically with the dense cermet material but which does not contain said binder phase; and subjecting the block and coating to a thermal cycle including heating above a temperature where a chemical reaction of the coating with the dense cermet material occurs and above a solidus temperature of the dense cermet material so as to cause a redistribution of the binder phase to form within the block of dense cermet material a binder phase gradient without contribution of external binder phase.

18. The process according to claim 17, wherein depositing comprises depositing the coating on only a portion of the surface of the block.

19. The process according to claim 17, wherein depositing comprises depositing the coating to completely cover all surfaces of the block.

20. The process according to claim 17, wherein the coating is composed of at least one compound selected from compounds of the nitride, boride, carbide, oxide, hydride, carbonitride, borocarbide or graphite type or of any mixture of these various compounds.

21. The process according to claim 17, further comprising attaching a diamond wafer of the PDC (Polycrystalline Diamond Compact) or TSP (Thermally Stable Polycrystalline diamond) type to a surface of the block.

22. The process according to claim 17, wherein the dense cermet material contains particles of natural or synthetic diamond.

* * * * *